US006581688B2

(12) United States Patent
Voll et al.

(10) Patent No.: US 6,581,688 B2
(45) Date of Patent: Jun. 24, 2003

(54) METHOD OF PACKING EXTENDED REACH HORIZONTAL WELLS

(75) Inventors: Benn Voll, Houston, TX (US); Hang Nguyen, Spring, TX (US); Kelvin Smejkal, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 78 days.

(21) Appl. No.: 09/818,406

(22) Filed: Mar. 27, 2001

(65) Prior Publication Data

US 2001/0047865 A1 Dec. 6, 2001

Related U.S. Application Data

(60) Provisional application No. 60/192,820, filed on Mar. 29, 2000.

(51) Int. Cl.[7] ..... E21B 43/04

(52) U.S. Cl. ..... 166/278; 166/51; 166/228; 166/250.14

(58) Field of Search ..... 166/278, 276, 166/51, 236, 228, 250.14

(56) References Cited

U.S. PATENT DOCUMENTS 2,685,340 A * 8/1954 Shea, Jr. et al. ..... 166/276
RE27,227 E * 11/1971 Harnsberger ..... 166/276
3,710,862 A * 1/1973 Young et al. ..... 166/131
4,046,198 A 9/1977 Gruesbeck et al. ..... 166/278
4,850,430 A * 7/1989 Copeland et al. ..... 166/276
5,058,677 A * 10/1991 Forrest ..... 166/278
5,409,061 A * 4/1995 Bullick ..... 166/205
6,237,687 B1 * 5/2001 Barbee et al. ..... 166/134

FOREIGN PATENT DOCUMENTS

BE 0 402 996 A1 12/1990
EP 0 260 727 A2 3/1988

* cited by examiner

*Primary Examiner*—David Bagnell
*Assistant Examiner*—Daniel P Stephenson
(74) *Attorney, Agent, or Firm*—Madan, Mossman & Sriram, P.C.

(57) ABSTRACT

The present invention provides a method for efficiently packing proppant in an extended reach, horizontal, open hole annulus. For a given set of fixed parameters, such as the wellbore size, screen size and formation fracture pressure, the method provides a combination of critical parameter values, including the proppant density, the mixture ratio of proppant and liquid and the pump rate which will yield an efficient and effective placement of the proppant in the annulus.

3 Claims, 5 Drawing Sheets

DUNE HEIGHT RATIO (Min) : 0.780 DUNE HEIGHT RATIO (Max) : 0.828

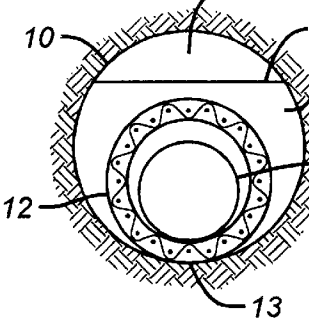
DUNE HEIGHT RATIO (Min) : 0.780
FIG. 1A
CRITICAL PARAMETERS
FLUID LOSS: 13.95%
BIT SIZE: 8.5"
EXP. HOLE DIA: 9.18"
SCREEN PIPE OD: 5.5"
WASH PIPE OD: 4"
FLUID VIS: 1cP
FLUID DENSITY: 9.3 ppg
MIX RATIO: 1 ppga
PUMP RATE: 4.3 bpm
FRAC GRADIENT: 0.659 psi/ft
PROP SIZE = 16/30
PROP DENSITY = 14 ppg
PROPPANT VOLUME BELOW PACKER: 86,000 lbs (1,368 ft3)
PROPPANT VOLUME AT SCREEN-OUT: 90,300 lbs (1,437 ft3)
FIG. 1C
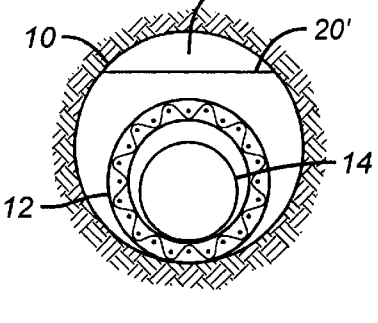
DUNE HEIGHT RATIO (Max) : 0.828
FIG. 1B
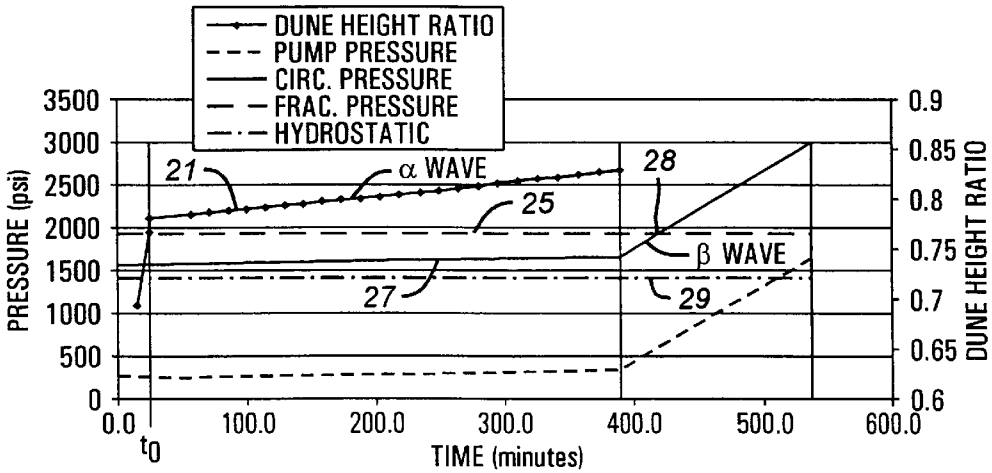
FIG. 2

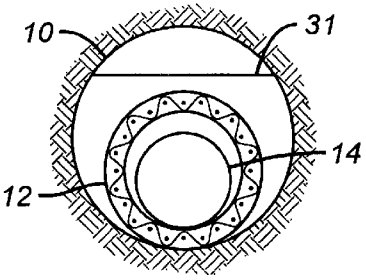
DUNE HEIGHT RATIO (Min) : 0.788
FIG. 3A
CRITICAL PARAMETERS
FLUID LOSS: 14.29%
BIT SIZE: 8.5"
EXP. HOLE DIA: 9.18"
SCREEN PIPE OD: 5.5"
WASH PIPE OD: 4"
FLUID VIS: 1cP
FLUID DENSITY: 9.3 ppg
MIX RATIO: 0.5 ppga
PUMP RATE: 2.8 bpm
FRAC GRADIENT: 0.659 psi/ft
PROP SIZE = 16/30
PROP DENSITY = 12 ppg
PROPPANT VOLUME BELOW PACKER: 73,700 lbs (1,368 ft3)
PROPPANT VOLUME AT SCREEN-OUT: 76,600 lbs (1,422 ft3)
FIG. 3C
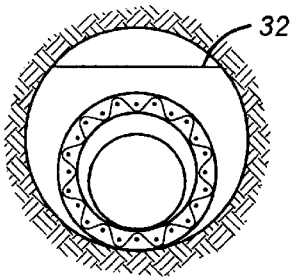
DUNE HEIGHT RATIO (Max) : 0.833
FIG. 3B
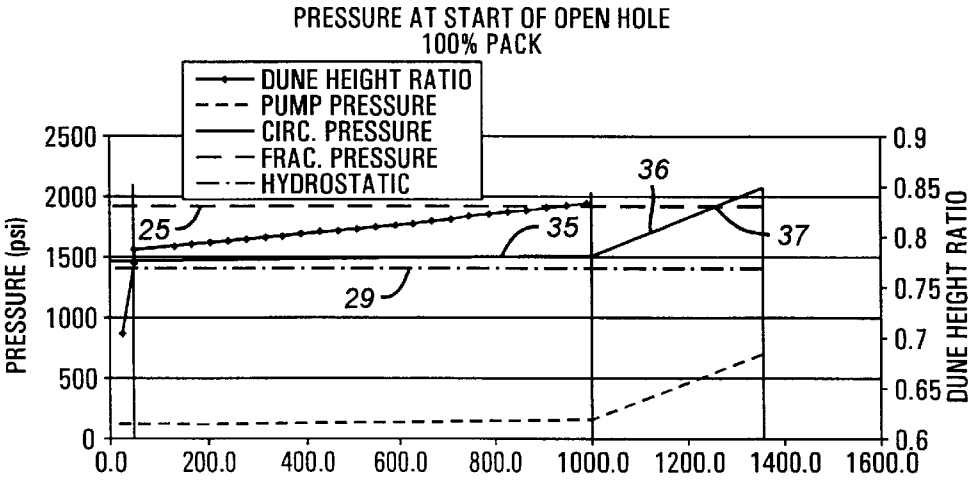
FIG. 4

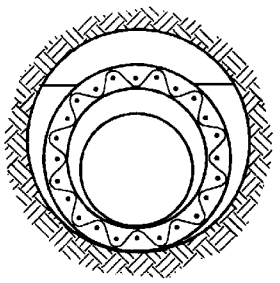
DUNE HEIGHT RATIO (Min) : 0.748
FIG. 5A
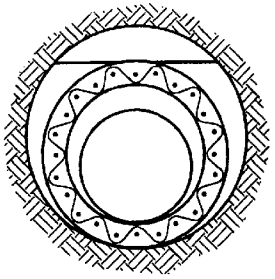
DUNE HEIGHT RATIO (Max) : 0.822
FIG. 5B
CRITICAL PARAMETERS
FLUID LOSS: 11.43%
BIT SIZE: 8.5"
EXP. HOLE DIA: 9.18"
SCREEN PIPE OD: 6.625"
WASH PIPE OD: 5"
FLUID VIS: 1cP
FLUID DENSITY: 9.3 ppg
MIX RATIO: 0.75 ppga
PUMP RATE: 3.5 bpm
FRAC GRADIENT: 0.659 psi/ft
PROP SIZE = 16/30
PROP DENSITY = 12 ppg
PROPPANT VOLUME BELOW PACKER:
44,900 lbs (834 ft3)
PROPPANT VOLUME AT SCREEN-OUT:
47,400 lbs (881 ft3)
FIG. 5C
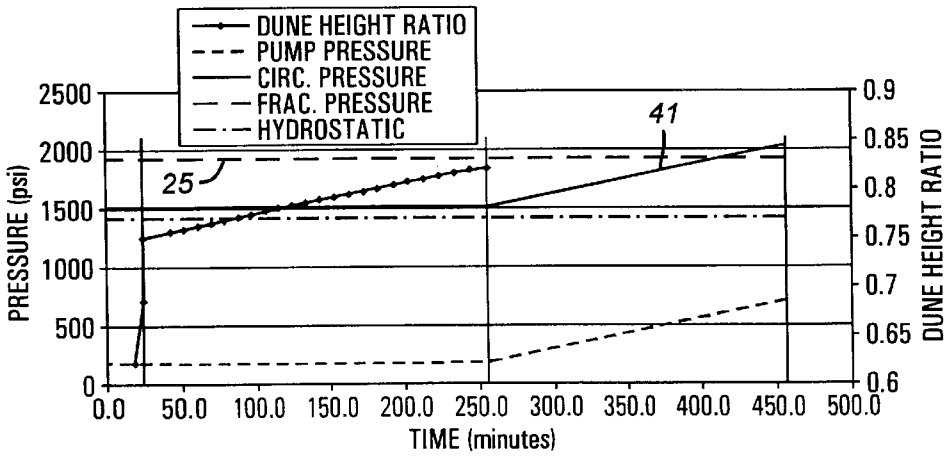
FIG. 6

METHOD OF PACKING EXTENDED REACH HORIZONTAL WELLS

This application is related to and claims priority from Provisional Application No. 60/192,820 filed Mar. 29, 2000.

BACKGROUND OF THE INVENTION

1. Field of the Invention

This invention relates generally to packing wells and more particularly to method of determining combination of critical parameters including the proppant density, proppant concentration, proppant to liquid mix ratio, screen size, pump rate, and circulating pressure, which will efficiently and effectively place the light weight proppants over an extended segment of a highly deviated or horizontal well, and then utilizing the selected parameters to pack the proppants in the well.

2. Description of the Related Art

Various techniques for open hole gravel packing of oil and gas wells are well known. Highly deviated and horizontal wells have become more common over the past few years. Wells which include several thousand feet of horizontal section, some times greater than 6,000 feet, have been drilled more recently and many such wells are expected to be drilled in the future. Wells with such long highly deviated or horizontal segments are referred to herein as the "extended reach horizontal wells." Gravel or sand, which is relatively heavy (specific gravity of 2.65) compared to the carrying fluid (usually salt water) cannot be used effectively for packing several thousand feet of a continuous section of annulus between the well and the screen. Lighter proppants, which may be made from a variety of synthetic materials, have been used in packing the annulus of highly deviated wells. Extended reach open hole wells pose particular problems due to excessive friction forces over the length of such long horizontal sections. The aim is to completely (100 percent) pack the annulus over the entire length of the screen, which, as noted above, may be as much as 6,000 feet or more.

A horizontal open hole gravel pack is accomplished by circulating gravel slurry into the well while keeping circulating pressures below the fracture pressure. At the start of the gravel pack, gravel is deposited around the screen along the bottom of the hole building to some height at which point the velocity is sufficient to wash it down the hole. This process is called the Alpha wave. When the gravel or Alpha wave reaches the bottom of the hole, gravel is then deposited on top of the Alpha wave and the wellbore is back filled. This is called the Beta wave. There is a minimum circulating rate below which it is not possible to transport the gravel or Alpha wave completely to the end of the well.

It is not always possible to efficiently or effectively gravel pack a horizontal open hole well with standard gravel having a specific gravity of 2.65. But for a given Alpha wave height, a lower density gravel can be pumped at a lower rate. It now becomes possible to one hundred percent (100%) gravel pack a well which would not have been possible with a 2.65 specific gravity gravel. The low weight gravel can be transported at lower rates, which reduces the circulating pressure and keeps it below the fracture pressure.

A screen is placed along the length of the horizontal section of the well to be packed. A mixture of the proppant and a liquid (generally sea water) is pumped into the annulus between the screen and the well. The screen acts as a strainer to deposit the proppant in the annulus and allows the clean fluid to return to the surface via a wash pipe that extends from the well bottom to the surface.

Because of the extended annulus length to be packed, it is critical to determine the various parameters that interact with each other for efficient and effective packing of the annulus. Such parameters include the density of the proppant, proppant concentration, fluid/proppant mixture ("slurry"), pump rate, screen size, washpipe size, hydrostatic pressure, and the fracture pressure of the formation. The inventors of this application have determined through experiments and simulation values of the combination of the critical parameters that will efficiently transport the proppant to the entire extended reach of the annulus and effectively pack such annulus. This invention further provides a completion string that will allow complete packing of the annulus even when a segment of the wellbore collapses during the packing process.

SUMMARY OF THE INVENTION

The present invention provides a method for efficiently packing proppant in open hole annulus. The method provides at least one combination of a plurality of parameters which will provide an efficient and safe packing operation for extended reach horizontal open holes. For a given set of fixed parameters, such as the wellbore size and screen size, fracture pressure, include the proppant density, proppant and liquid mix ratio and pump rate. The wellbore size and the screen size are initially input into a simulation program which provides a combination of parameters that may include the total pack time for the Alpha wave (forward fill) and the Beta wave (back fill), the proppant density, proppant size, proppant and liquid mix ratio, the circulating pressure profile during packing operation. The packing operation is performed using the parameters that will provide the most efficient and effective packing operation.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein:

FIG. 1 is a cross section of a horizontal well showing minimum and maximum dune height ratios for a set of gravel pack operating parameters.

FIG. 2 is a relationship of circulating pressure, fracture pressure and the expected time for potentially packing the well configuration and parameters shown in FIG. 1.

FIG. 3 shows a cross section similar to FIG. 1 for a different set of parameters.

FIG. 4 shows the pressure and time relationships for proppant packing corresponding to the parameters shown in FIG. 3.

FIG. 5 shows a cross section similar to FIG. 1 for a 6.25 inch screen and a selected set of parameters.

FIG. 6 shows the pressure and time relationships for proppant packing corresponding to the parameters of FIG. 5.

DETAILED DESCRIPTION OF THE PREFERRED EMBODIMENT

Figure 7:
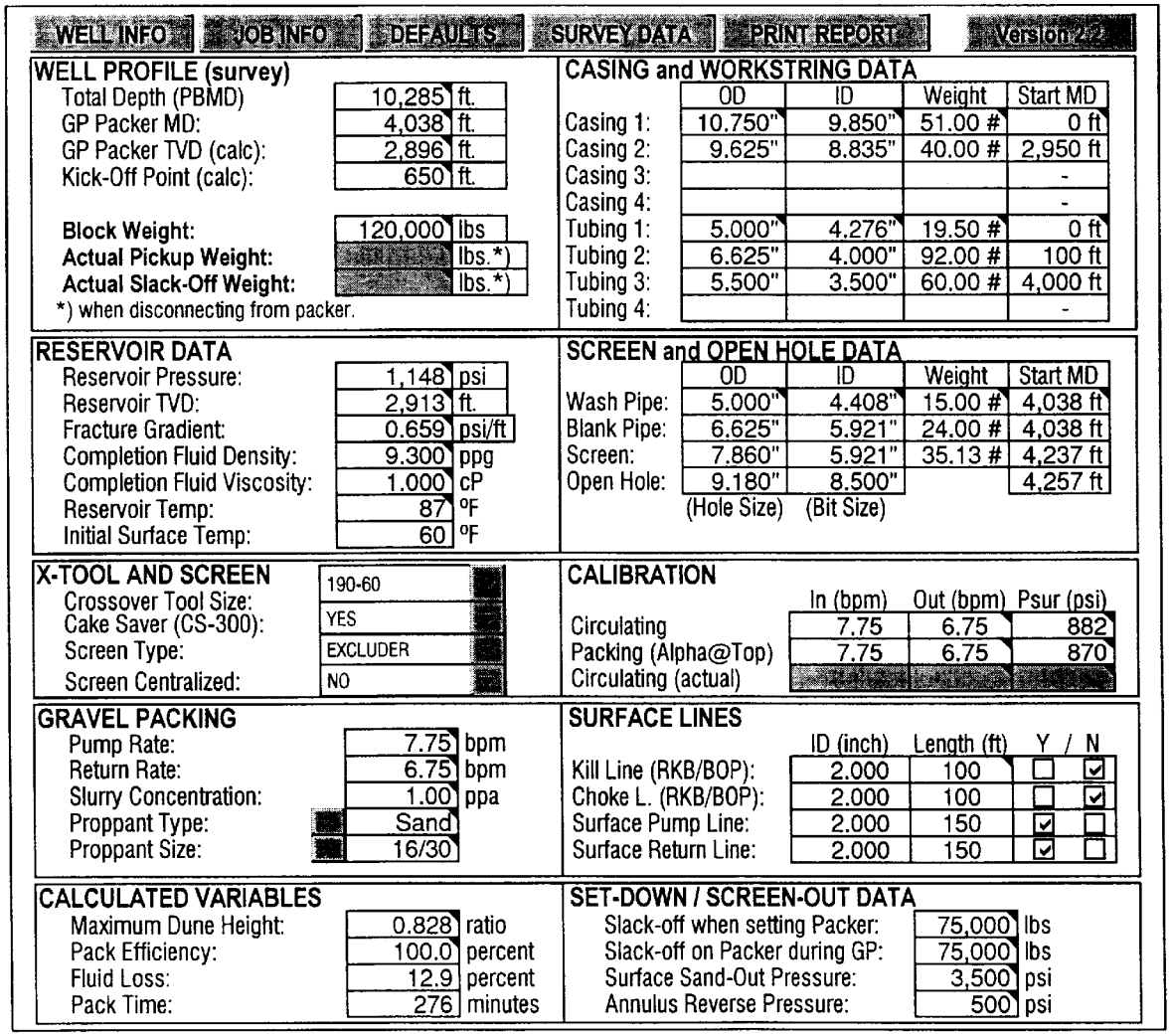
FIG. 7 shows the type of input data for performing simulation to obtain the results shown in FIGS. 2, 4, and 6.

Gravel packing highly deviated wells using conventional products and compensation techniques is extremely difficult. As well deviation increases, pump rate and carrier fluid viscosities are increased to prevent particle setting. Prior art studies have shown that particle placement efficiency improves as the particle density "$D_p$" and carrier fluid density "$D_f$" become closer. In an ideal system, these densities would be equal ($D_p$: $D_f$=1). Pack materials with density of 1.65 g/cc or so (which is substantially less than 2.65 g/cc, the density of sand) have been proposed for packing wellbore annulus. It has been proposed that lowering gravel concentration, decreasing particle diameter, decreasing particle density, increasing pump rate and increasing resistance to fluid flow in the wash pipe/screen annulus increases the packing efficiency. Additionally, it has been proposed that reducing the length of blank sections in the screen and reducing the fluid viscosity also increase the packing efficiency. The inventors of this application have determined that the problems encountered in packing open hole annulus are exacerbated in extended reach horizontal wells and that the prior art techniques do not provide combinations of specific values of critical parameters that will result in efficient and effective open hole packing. The term "efficient" is used herein to mean the time it takes to gravel pack a given length of the well annulus while the term "effective" means the degree of gravel pack. This invention provides a more comprehensive and integrated method for determining the valves of a set of critical parameters for efficient and effective packing of open hole well annulus for extended reach wells.

The inventors of the present invention have determined, through a series of test runs, that proppant density and the screen size (particularly the outside diameter) are among the two most critical parameters design factors. If a fixed screen size is chosen, proppant density remains as the key factor in optimizing proppant placement. The studies were conducted to determine the critical parameters for a 6,000 foot horizontal section. With lower density gravel the screen size can be increased which improves the efficiency of the pack. With a large screen less gravel is required thus the pack time can be reduced by as much as fifty percent (50%). Table 1 below shows that for such a long horizontal section, even certain light weight proppants are impractical for a 5.5 inch diameter screen.

This is evident from the results for the 5.5 inch screen, where it would take twenty-three (23) hours to complete the packing, which is very impractical. However, packing of a 6⅝ inch screen with the same proppant can be accomplished in eight (8) hours. The study of Table 1 is based on: brine weight/viscosity of 9.3 ppg/1cp; and frac gradient of 0.659 psi/ft. In Table 1 ppga means pounds per gallon of proppant added to the liquid and ppg means pounds per gallon weight (density of the proppant). The term "Not Possible" indicates that the well will fracture if the packing is attempted.

TABLE 1

| Screen and Proppant Combination | Pump Time | Hydraulics |
|---|---|---|
| 5½" - 1 ppa Gravel | 9 hours | Not Possible |
| 5½" - 1 ppa Light Weight Proppant | 9 hours | Not Possible |

TABLE 1-continued

| Screen and Proppant Combination | Pump Time | Hydraulics |
|---|---|---|
| (14 ppg) | | |
| 5½" - 1 ppa Light Weight Proppant (12 ppg) | 9 hours | Not Possible |
| 5½" - 0.5 ppa Light Weight Proppant (12 ppg) | 23 hours | Possible |
| 6⅝" - 1 ppa Gravel | 5 hours | Not Possible |
| 6⅝" - 1 ppa Light Weight Proppant (14 ppg) | 5 hours | Not Possible |
| 6⅝" - 1 ppa Light Weight Proppant (12 ppg) | 5½ hours | Not Possible |
| 6⅝" - 0.75 ppa Light Weight Proppant (12 ppg) | 8 hours | Possible |

FIG. 1 shows the minimum and maximum dune height ratios for Alpha waves (wave of proppant going downhole to fill the annulus). The selected values of the critical parameters are listed in Table C of FIG. 1. In FIG. 1, a screen 12 is placed along the length of the horizontal section of the well 10. In this configuration, no centralizers are used. The screen, thus, is shown lying at the bottom section 13 of the well 10. A wash pipe 14 is placed inside the screen 12 to provide a return path for the clean fluid. In Section A of FIG. 1, the annulus 11 between the screen 12 and the well 10 must be fully one hundred percent (100%) packed with the selected proppant. The minimum and maximum Alpha dune heights are defined by the levels 20 and 20', respectively. The critical parameters used are listed in the table of Section C of FIG. 1. The screen size chosen is 5.5 inches outside diameter ("OD"), with a 4-inch OD wash pipe and proppant density of 14 ppg. The pump rate is 4.3 bpm, while the proppant size is 16/30 us mesh standard.

FIG. 2 shows pressure and time relationship for packing according to the configuration and critical parameters of FIG. 1. The pressure is shown along the left vertical axis while the dune height ratio is along the right vertical axis. The packing time is shown along the horizontal or x-axis. The frac pressure 25 is computed from the frac gradient of 0.659 psi/ft. During the initial packing, the circulating pressure 27 remains below the frac pressure 25 until the Alpha wave is complete, which is shown to take about 390 minutes. The circulating pressure during the back fill (Beta wave) then starts to rise and crosses over the frac pressure at 28. Thus, the circulating pressure exceeds the frac pressure until the packing is complete which is expected to take about 540 minutes. Thus this model may not be proper for packing the well as the well may fracture during the Beta wave.

FIG. 3 and FIG. 4 show the minimum and maximum dune heights 31 and 32 respectively and their corresponding dune height ratios when proppant of density 12 ppg with a mix ratio of 0.5 ppga and pump rate of 2.8 bpm are used. As shown in FIG. 4, the circulating pressure 35 is below the frac pressure 25 throughout the Alpha wave while the circulating pressure 36 during the Beta wave is below the frac pressure 25 until the crossover point 37 (til about 1300 minutes) and then continues to rise above the frac pressure until the completion of the packing process at about 1380 minutes. It is thus noted that the packing process is not entirely suitable with a 5.5 inch OD screen even with a relatively light proppant with density 12 ppg, but in many instances may be adequate to finish the operations.

FIG. 5 and FIG. 6 show an example of the packing efficiency profile for a screen with 6.625 OD for a proppant with 12 ppg density, a mix ratio of 0.75 ppga and a 3.5 bpm pump rate. The circulating pressure 41 during much of the Beta wave remains below the frac pressure and the one hundred percent (100%) pack will be completed in a relatively short time (about 450 minutes), which is substantially more efficient than the method and configuration shown in FIG. 3 and FIG. 4. The type of data entered into the simulation is shown in FIG. 7.

In an alternative method the packing process may be carried out with two sets of parameter values, one during the Alpha wave and the other during the Beta wave. For example, the values of the parameters are determined that will provide relatively fast Alpha wave operation (combination of proppant size, mix ratio, pump role, washpipe size etc.) and since the circulating pressure is mainly a problem during the Beta wave, this segment of the operation may be performed using a different set of parameters that will ensure that the circulating pressure remains below a predetermined pressure value, typically the fracture pressure. Thus, the present invention can provide values of the critical parameters for different segments of the packing operation that in total will provide the most efficient operation for one hundred percent (100%) pack.

In one mode of simulation according to the present invention, the screen size, frac pressure, friction forces for the wellbore, carrier fluid density or certain other fixed parameters are provided as input and the simulation program through an iterative process determines the operating parameters that will provide the most efficient packing operations for one hundred percent (100%) packing over the entire length of the annulus. The operating parameters include (one or more) the proppant density, proppant concentration, fluid flow or the pump rate, the total time for one hundred percent (100%) packing. The system also provides the minimum and maximum Alpha wave dune heights or dune height ratios. This allows the operator to perform the packing operations very efficiently and with reasonable certainty compared to the prior methods.

Figure 8:
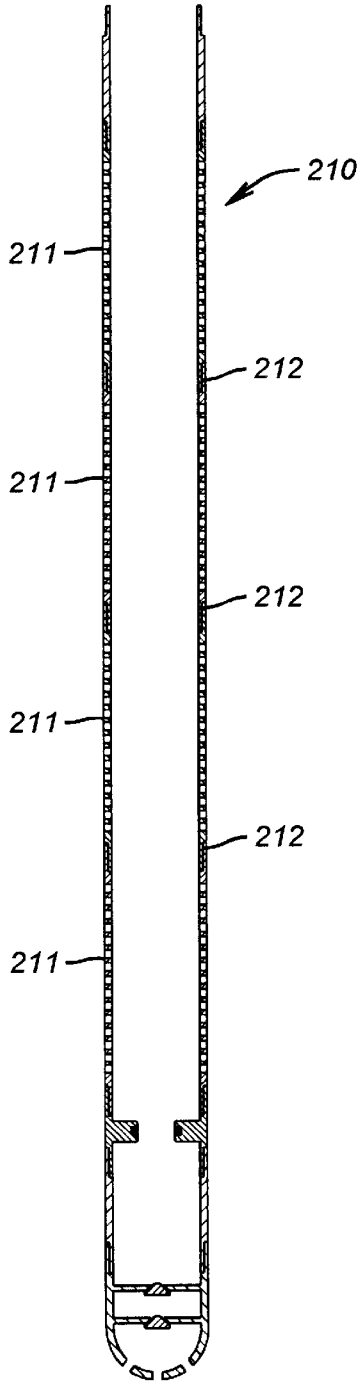
FIG. 8 is a line diagram of a shroud assembly for use as part of a screen assembly.
Figure 9:
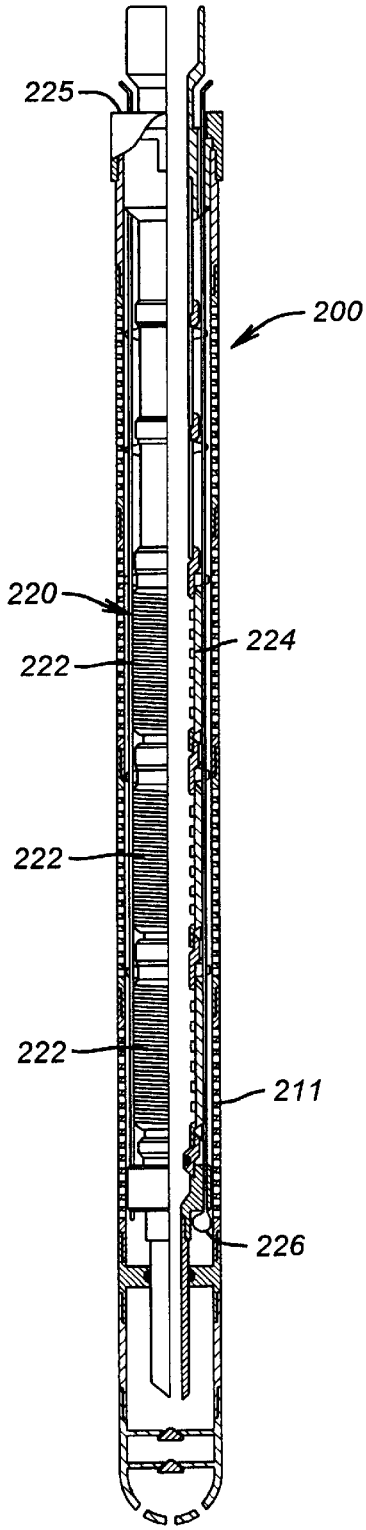
FIG. 9 is a line diagram of a screen assembly for use in a packing and extended reach horizontal well.

The results of the above-described simulation method are preferably used with the string shown in FIG. 8 and FIG. 9 for packing the annulus of an extended reach horizontal well. The annulus section or segment to be packed with the proppant is first lined with a screen assembly 200 of sufficient length to cover the entire length of the horizontal well to be packed. The assembly includes a perforated shroud 210, which is illustrated by FIG. 8 independently of the screen section 220. The shroud may be made of smaller jointed sections 211 joined at joints 212. Each individual perforated section 211 is preferably approximately 90 feet long. The screen section 220, which is made by joining individual screens 222 is disposed inside the perforated shroud 210. The screen section 220 may be any type that can be suitably placed inside the shroud 210. There remains a continuous annular gap 224 between the screen section 220 and the shroud 210. This gap is sufficient to allow the packing fluid to travel from the top end of the screen 225 to the bottom end 226, in case the annulus between the shroud 210 and the formation closes due to inadvertent collapse of the formation. The perforated shroud acts as a liner between the screen 220 and the formation. The shroud is relatively thin with sufficient perforations that allow free flow of the proppant fluid in the annulus and is sufficiently strong to hold off any collapse of the formation.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method of packing proppant in an annulus between a wellbore and a screen placed along a length of the wellbore, comprising:

(a) defining the approximate fracture pressure of an earth formation surrounding the screen;

(b) defining at least one dimension of the annulus to be packed;

(c) defining at least one density parameter of the proppant;

(d) determining a parametric relationship among circulating pressure, fluid pump rate and optimum time for substantially fully packing the annulus that will allow packing of the annulus without fracturing the wellbore;

(e) determining values for circulation pressure less than the well fracturing pressure and fluid pump rate values corresponding to said optimum time for packing said annulus; and, (f) packing the well in accordance with the determined relationship and values.

2. The method according to claim 1 further comprising determining the value of circulating pressure during a procedure of back filling the well annulus.

3. The method according to claim 1, wherein determination of the parametric relationship includes a first relationship for forward packing and a second relationship for back filling the well annulus.

* * * * *